United States Patent [19]

Herron

[11] Patent Number: 5,036,441

[45] Date of Patent: Jul. 30, 1991

[54] ILLUMINATED PUSH BUTTON

[75] Inventor: William L. Herron, Elizabeth, N.J.

[73] Assignee: Trine Products Corp., Bronx, N.Y.

[21] Appl. No.: 506,469

[22] Filed: Apr. 9, 1990

[51] Int. Cl.[5] ..... F21V 33/00

[52] U.S. Cl. ..... 362/95; 200/314

[58] Field of Search ..... 362/276, 800, 802, 253, 362/95; 340/330, 815.13; 200/314

[56] References Cited

U.S. PATENT DOCUMENTS

| | | | |
|---|---|---|---|
| 2,802,082 | 8/1957 | Kalwo | 200/314 X |
| 3,309,697 | 3/1967 | Skrbina | 340/815.13 |
| 3,590,234 | 6/1971 | Bartick | 362/802 X |
| 3,934,105 | 1/1976 | Lockard | 362/800 X |
| 4,293,894 | 10/1981 | Blank | 362/191 X |
| 4,500,774 | 2/1985 | Honjo | 362/802 X |
| 4,694,130 | 9/1987 | Kitzmann et al. | 200/314 |
| 4,745,527 | 5/1988 | Belverio, Jr. et al. | 362/800 X |

FOREIGN PATENT DOCUMENTS

| | | | |
|---|---|---|---|
| 584151 | 9/1933 | Fed. Rep. of Germany | 362/95 |
| 2610713 | 9/1977 | Fed. Rep. of Germany . | |
| 1524484 | 9/1978 | United Kingdom . | |

*Primary Examiner*—Stephen F. Husar

*Attorney, Agent, or Firm*—Brooks Haidt Haffner & Delahunty

[57] ABSTRACT

An illuminated electrical push button switch has a pair of spring contacts secured in a housing on either side of a miniature bulb. The contacts have inclined bifurcated ends that bear resiliently against the underside of the push button. Depressing the button causes the bifurcated contact ends to deform elastically and come together making electrical contact. The pigtail leads for the bulb are sandwiched between the contacts and a block portion of the housing, all being held in place by a screw that also functions as a binding post for the external wire connection.

9 Claims, 1 Drawing Sheet

ILLUMINATED PUSH BUTTON

BACKGROUND OF THE INVENTION

The present invention relates to push button switch assemblies, and, more particularly, to illuminated push button switches commonly used in connection with door bells, chimes or the like.

Heretofore, push buttons of this type have been made with at least a dozen parts including a helical compression spring, contacts, screws, a bulb, a button and a housing. Both the cost of producing the individual parts and the cost of assembly have been higher than need be.

Therefore, it is an object of the present invention to provide an illuminated push button switch of simple, economic construction.

It is a further object of the invention both to reduce the number of component parts of the push button switch and the labor required to assemble such parts.

Various other objects will become apparent after reading the ensuing description.

SUMMARY OF THE INVENTION

In accordance with the present invention there is provided an illuminated push button switch assembly comprising in combination a housing, an electrically energizeable light emitting device, a pair of spaced apart electrically conductive spring metal contacts, a push button coupled to said housing for travel relative thereto, and means for separately connecting to each of said contacts an external electrical conductor, said contacts each being mounted in said housing in electrical contact with means for establishing an electrical connection to said light emitting device, said contacts being disposed within said housing for engagement by said push button which upon depression causes said contacts to engage closing an electrical circuit shunting said light emitting device and completing a circuit for an external source through said electrical conductors, said contacts being interposed between said push button and said housing for exerting a spring return force upon said push button.

BRIEF DESCRIPTION OF THE DRAWINGS

The invention will be better understood after reading the following detailed description of the presently preferred embodiment thereof with reference to the appended drawings in which.

The same reference numerals are used throughout the various figures of the drawings to designate the same or similar part.

DETAILED DESCRIPTION OF THE PRESENTLY PREFERRED EMBODIMENT

Figure 1:
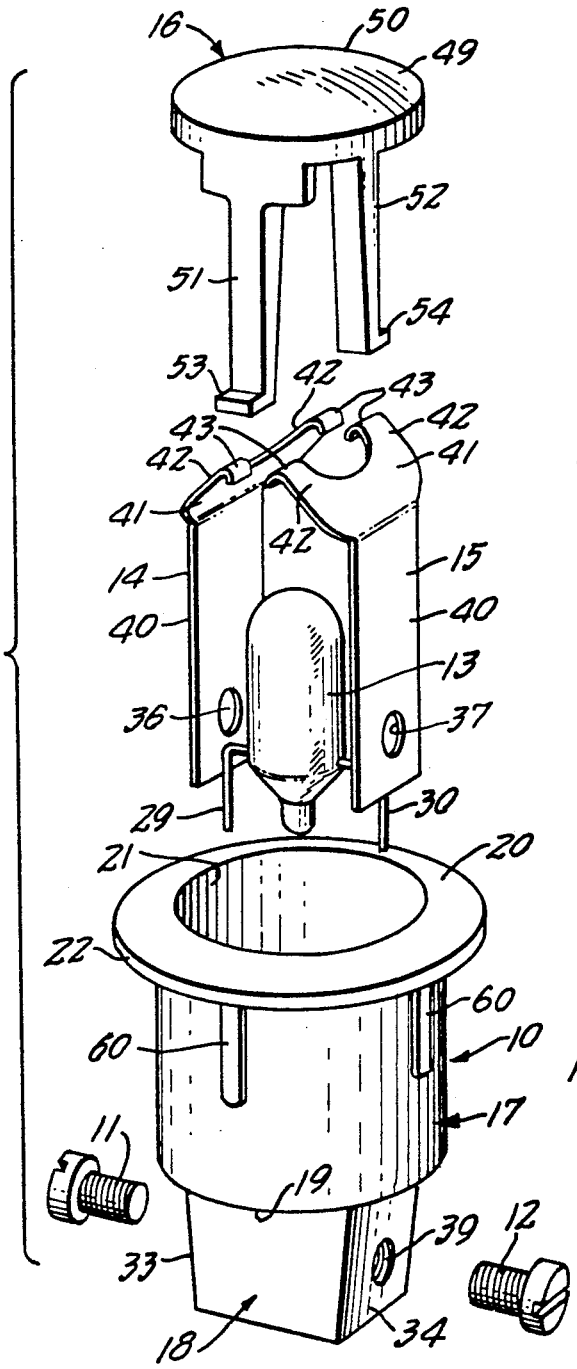
FIG. 1 is an exploded perspective view of a push button switch embodying the invention and showing the seven component parts.
Figure 2:
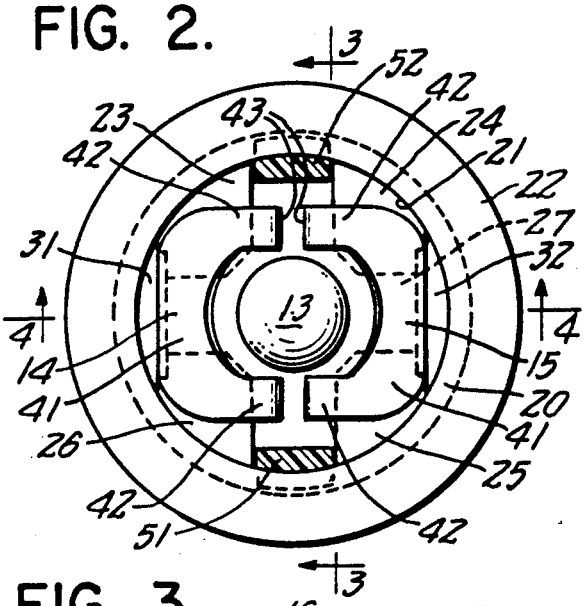
FIG. 2 is a top plan view of the assembled push button with part of the button broken away to reveal the internal construction.
Figure 3:
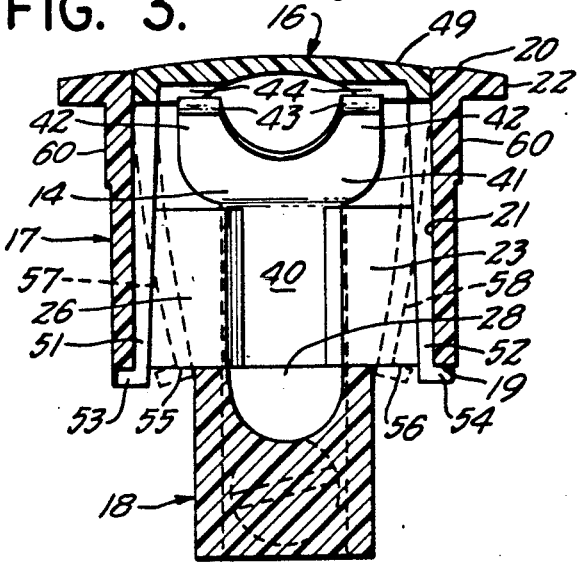
FIG. 3 is a vertical sectional view taken along the line 3—3 in FIG. 2.
Figure 4:
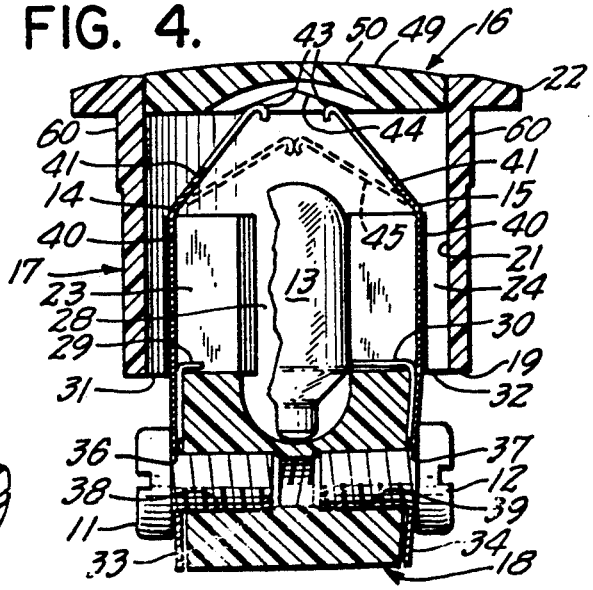
FIG. 4 is a vertical sectional view taken along the line 4—4 in FIG. 2.

Referring to the drawings, the illuminated push button switch consists of a housing 10, two screws, 11 and 12, a miniature lamp 13, two contacts, 14 and 15, and a button 16. The housing 10 has a cylindrical body portion 17 and an integral mounting block portion 18. The housing 10, including the body portion 17 and the block portion 18, can be molded as a unit from a plastic, such as an acetal copolymer sold under the trademark "CELCON" by Hoechst Celanese Corp., Somerville, N.J. The portion 18, as shown, is joined to the base 19 of the cylindrical portion 17. The opposite end 20 of the cylindrical portion 17 has a cylindrical counterbore 21 that extends down into the cylindrical portion 17. The mouth of the counterbore 21 is surrounded by a radially extending flange 22 tapered from a greater thickness at the mouth of the counterbore to a lesser thickness at its outer edge as shown in FIGS. 3 and 4. The lower internal region of portion 17 has four radially inwardly extending blocks 23, 24, 25 and 26 separated circumferentially from each other thereby creating a cruciform cavity 27 having cavity arms radiating from a central cavity 28.

The central cavity 28 is sized to receive with a loose fit the bulb 13 which is of a known type and generally contains a filament energizable by the relatively low voltage customarily used with bell or chime. The bulb 13 has pigtail leads 29 and 30.

As best seen in FIG. 4, the cylindrical portion 17 overhangs the block portion 18 and is provided with two openings, 31 and 32, in the bottom wall at the base 19 of the cylindrical portion 17. The openings 31 and 32 are of a size sufficient to accommodate the respective contact 14 or 15 which is passed therethrough after insertion of bulb 13. As the contact 14 or 15 is passed through the corresponding opening 31 or 32 the contact encounters the corresponding lead 29 or 30 of bulb 13 carrying the lead downward and over the side face 33 or 34 of block 18 so as to capture the corresponding lead 29 or 30 between contact 14 or 15 and block face 33 or 34. Insertion of screws 11 and 12, which are preferably self-tapping, through apertures 36 and 37, respectively, in contacts 14 and 15 into bores 38 and 39 in block 18 simultaneously secure the contacts 14 and 15 to block 18 and capture the bulb leads 29 and 30. Obviously, it may be preferred to provide a single through bore between faces 33 and 34 of block portion 18 rather than separate bores 38 and 39 to receive the screws 11 and 12.

As shown in the drawings, the contacts 14 and 15 each has a rectangular portion 40 and a slightly laterally diverging bifurcated portion 41 inclined at a suitable angle cantilevered from portion 40. The arms 42 of the portion 41 end in a rolled over portion 43. As shown in FIG. 4, the portions 41 of the contacts 14 and 15 are flexed and brought together by depressing the button 16 whose undersurface is provided with depressions bounded by inclined surfaces 44 that function as camming surfaces to cause the flexure of contact portions 41 until the portions 43 on opposing contacts 14 and 15 come into contacting engagement as shown by the dashed lines 45.

The button 16 can be molded from a plastic, such as the acetal copolymer identified hereinbefore and has a translucent head 49, with a shallow generally spherical outer surface 50 and an inner surface provided with the surfaces 44. Depending from the head 49 are diametrally located, elastic legs 51 and 52 terminating in radial projections or barbs 53 and 54, respectively. Upon assembly the legs 51 and 52 pass downward in counterbore 21 through the space between blocks 23 and 24 on one side and 25 and 26 on the other side until the barbs 53 and 54 pass through openings 55 and 56 in the bottom wall adjacent the side wall of cylindrical portion 17. Upon passing through the openings 55 and 56 the legs 51 and 52, having been deflected to the dashed line positions 57 and 58 (see FIG. 3), spring radially outwardly engaging the base 19 of portion 17. If desired, instead of engaging the base 19 of the portion 17, the wall of the portion 17 may be provided with through openings into which the barbs 53 and 54 can extend.

The contacts 14 and 15 are made of suitable spring metal that also has good electrical conductivity. It is presently preferred to use beryllium copper for this purpose with the grain running lengthwise. The button 16 and housing 20 can be made of any suitable moldable plastic material.

Generally, the housing 20 is provided with some means for securing the assembly in an escutcheon or the like. As illustrated, the housing 10 is intended to be mounted in an opening, bore or cavity and has a plurality of circumferentially spaced, radially projecting ribs 60 for gripping the wall of the cavity in the escutcheon. However, it may be preferred to develop a plurality of spring locks in the side wall of cylindrical portion 17 which serve to lock the assembly in the receiving bore. Actually, any suitable known means can be provided tailored to the particular design of the receptacle.

The notch in the portion 41 which defines the bifurcation in contacts 14 and 15 should be sufficient to enable light from the bulb 13 to reach the head 49 of the button 16. It should be apparent that the screws 11 and 12, besides securing the contacts in the housing, also serve as the means for connecting wires thereto for establishing electrical connection of the bell or chime circuit to the switch assembly.

Assembly of the push button switch is of the utmost simplicity. With the exception of the screws, the parts are merely guided into position and automatically held in place. As explained above, the bulb 13, is inserted first into the housing 10. Then the contacts 14 and 15 are inserted and force the wires from the bulb down alongside the block portion of the housing. This action holds the bulb in place while providing positive electrical contact. The button is then inserted in the housing until the barbs 53 and 54 on the ends of the legs 51 and 52 snap out below the housing skirt to prevent the button from rising above its quiescent position. The resistance of the spring contacts, acting on the underside of button 16, force the button up to its non-activated position restrained by the barbs 53 and 54 encountering the bottom 19 of the portion 17. The screws 11 and 12 are now inserted through the apertures 36 and 37 in the contacts and threaded into the holes 38 and 39 in block 18. Self-tapping, the screws will cut their own thread. To replace the bulb 13 it is a simple matter of removing the parts in reverse order, the button 16 being removable after the arms 51 and 52 are bent inwardly by pushing on the barbs 53 and 54 until their ends are disengaged from the end 19 of the housing 17.

Although not shown in the drawings, the contacts 14 and 15 can each have a tab struck from the rectangular portion 40 an appropriate distance above the apertures 36 and 37 such that the tabs overlie and engage the respective bulb leads 29 and 30 when the contacts are installed in the housing 20. The tabs engaging the bulb leads will insure that the bulb cannot move out of position when the screws 11 and 12 are loosened.

Having described the invention with reference to the presently preferred embodiment thereof, it should be apparent that various changes in construction can be effected without departing from the true spirit of the invention as defined in the appended claims.

What is claimed is:

1. An illuminated push button switch assembly comprising in combination a housing, an electrically energizeable light emitting device, a pair of spaced apart electrically conductive spring metal contacts, a push button coupled to said housing for travel relative thereto, and means for separately connecting to each of said contacts an external electrical conductor, said contacts each being mounted in said housing in electrical contact with means for establishing an electrical connection to said light emitting device, said contacts being disposed within said housing for engagement by said push button which upon depression causes said contacts to flex and engage closing an electrical circuit shunting said light emitting device and completing a circuit for an external source through said means for connecting an external electrical conductor, said contacts being interposed between said push button and said housing for exerting a spring return force upon said push button.

2. An illuminated push button switch assembly according to claim 1, wherein said push button has an inner surface that engages both of said contacts, said contacts each comprising an elongated strip of said conductive spring metal with a first end secured to said housing and a second end extending cantilevered from the corresponding said first end into contact with said inner surface of the push button at an acute angle relative to the direction of movement of said push button and toward and into non-engaging proximity with the second end of said other contact, whereby depression of said push button flexes both of said contact second ends toward and into mutual contact.

3. An illuminated push button switch assembly according to claim 1 wherein said housing has a cylindrical counterbore surrounded by a wall and said push button is mounted in said counterbore for sliding movement relative to said housing axially of said counterbore, said button has a head disposed at the upper end of said wall and a pair of elastic legs extending downwardly from said head toward the lower end of said wall, each of said legs having a barb at its lower end extending radially outwardly of the axis of said counterbore and said legs being spaced outwardly of said axis and being spaced from each other in the direction circumferentially of said axis, and said wall having a surface extending transversely to said axis with which said barbs are engageable for holding said button within said counterbore.

4. An illuminated push button switch assembly according to claim 3 wherein said transversely extending wall surface is at the bottom end of said wall.

5. An illuminated push button switch assembly according to claim 3 wherein at least a part of said button head is translucent.

6. An illuminated push button switch assembly according to claim 1, wherein said contacts are each secured to said housing by said means for connecting one of said conductors thereto.

7. An illuminated push button switch assembly comprising in combination a housing, an electrically energizeable light emitting device, a pair of spaced apart electrically conductive spring metal contacts, a push button coupled to said housing for travel relative thereto, and means for separately connecting to each of said contacts an external electrical conductor, said contacts each being mounted in said housing in electrical contact with means for establishing an electrical connection to said light emitting device and disposed for engagement by said push button which upon depression causes said contacts to flex and engage closing an electrical circuit shunting said light emitting device and completing a circuit for an external source through said means for connecting an external electrical conductor, said contacts being interposed between said push button and said housing for exerting a spring return force upon said push button, said push button having an inner surface that engages both of said contacts, said contacts each comprising an elongated strip of conductive spring metal with a first end secured to said housing and a second end extending cantilevered from the corresponding said first end into contact with said inner surface of the push button at an acute angle relative to the direction of movement of said push button and toward and into non-engaging proximity with the second end of said other contact, whereby depression of said push button flexes both of said contact second ends toward and into mutual contact, said first ends of said contacts being secured to said housing at diametrically opposed locations on opposite sides of the axis of travel of said push button, said light emitting device being disposed between said first ends of said contacts, and said second ends of said contacts are bifurcated for providing an opening through which light emitted by said emitting device can reach said inner surface of said push button.

8. An illuminated push button switch assembly according to claim 7, wherein said inner surface of said push button has regions that are inclined relative to the normal to said axis of travel which regions are located for engagement by said second ends of said contacts for providing a camming action to said contacts when said button is depressed.

9. An illuminated push button switch assembly according to claim 8, wherein said light emitting device is a miniature bulb, said housing has a central cavity for receiving said bulb, said bulb has a pair of wire leads for connection each to a different one of said contacts, said wire leads being sandwiched between said first end portions of said contacts and a portion of said housing.

* * * * *